US006022304A

United States Patent [19]

Tornabene et al.

[11] Patent Number: 6,022,304

[45] Date of Patent: Feb. 8, 2000

[54] EXERCISE APPARATUS

[76] Inventors: Dean Tornabene, 4015 Glenco Ave. Unit 8, Marina Del Rey, Calif. 90292; Charles Perez, 530 Brooks Ave., Venice, Calif. 90291

[21] Appl. No.: 09/260,830

[22] Filed: Mar. 2, 1999

Related U.S. Application Data

[60] Provisional application No. 60/113,030, Dec. 21, 1998.

[51] Int. Cl.[7] ..... A63B 26/00

[52] U.S. Cl. ..... 482/140; 482/146

[58] Field of Search ..... 482/146, 140, 482/72

[56] References Cited

U.S. PATENT DOCUMENTS 4,600,196 7/1986 Jones .
5,346,447 9/1994 Stearns .
5,441,473 8/1995 Safani et al. .
5,575,741 11/1996 Fan ..... 482/72
5,591,111 1/1997 Wang et al. .
5,599,261 2/1997 Easley et al. .
5,772,562 6/1998 Stevens .
5,776,039 7/1998 Perez, Jr. .
5,779,607 7/1998 Harris .

*Primary Examiner*—Richard J. Apley
*Assistant Examiner*—Lori Baker
*Attorney, Agent, or Firm*—Howard A. Kenyon

[57] ABSTRACT

An exercise apparatus that exercises at least two groups of muscles is disclosed. The apparatus utilizes a seated position for the person exercising and incorporates a elastomeric tension members to provide a resistance. The exercise apparatus has a seat and two legs formed on a semi-circle frame. Two rotatable arms have vertical adjusting means to accommodate persons of different statue. The present invention can be folded into a compact, easily transportable and storable unit.

2 Claims, 4 Drawing Sheets

EXERCISE APPARATUS

CROSS REFERENCE TO RELATED APPLICATION

The present application is a Continuation-in-Part of my co-pending Provisional application number 60/113,030 filed Dec. 21, 1998 for an Exercise Apparatus.

BACKGROUND OF THE INVENTION

1. Field of the Invention

This invention relates to an exercise apparatus and more particularly the present invention is directed to an exercise apparatus for the conditioning of the muscles of the abdomen and the back.

2. Description of the Prior Art

Many devises exist for exercising various parts of the body for commercial and home use. Some of the prior art devices are:

U.S. Pat. No. 5,779,607 to Harris. Harris provides an abdominal exercise machines which uses the weight of the user as the resisted element.

U.S. Pat. No. 5,772,562 to Stevens shows an exercise apparatus where the resistive reducing element is incorporated into the pivotal connection.

U.S. Pat. No. 5,441,473 to Safani et al is limited to exercising the back.

U.S. Pat. No. 5,591,111 to Wang et al utilizes a spring inside a wheel that rolls on the floor to provide a resistance.

U.S. Pat. No. 5,599,261 to Easley describes an exercise apparatus for exercising at least two groups of muscles.

U.S. Pat. No. 5,346,447 to Sterns describes an exercise machines that uses as its resistive element the weight of the user.

U.S. Pat. No. 4,600,195 to Jones is a permanent commercial type of exercise machine that provides variable resistance with the use of a plurality of elastic cords that selectively are connected to the exercise lever for varying the amount of the resistive force.

SUMMARY OF THE INVENTION

It is the object of the present invention to provide an exercise apparatus useful in the connection with the performance of abdominal and back exercises.

It is yet another object of the present invention to provide an exercise apparatus incorporating structural members that can be adjusted to require selectable levels of work during the performance of repetition type abdominal back exercises.

It is a further object of the present invention to provide an exercise apparatus that can be folded flat for storage.

It is still a further object of the present invention to provide an exercise apparatus that can be efficiently and economically manufactured.

Briefly, in accordance with the present invention there is provided an exercise apparatus that comprises a generally tubular frame having a rectangular seat and having two angle members attached to the front and rear of the seat. Two tubular semi-circular members are pivotally attached to the angle members at each end and the semi-circular members have spring biased pins that lock the semi-circular members in a position that is perpendicular to the seat or a position that is parallel to the seat. The semi-circular members are designed to sit on a horizontal support surface (a floor or the like). A resilient material is placed on the contact surface of the semi-circular members with the floor or the like to provide a cushioning effect. Attached to the rear portion of each of the semi-circular members are adjusting members that are fixed and extend outward relative to the semi-circular members. The adjusting members have two sides with notches therein and a bottom that is attached to each of the two sides. The attaching members have a bolt that extends through the adjustment members. On the portion of the bold that extends through the adjusting member, is a rotatable sleeve which is attached to a lower portion of a rotating arm. The lower portion of the rotating arm is encircled by a spring biased sleeve having pins that fit into the notches of the adjusting members. The lower portion of the rotating arm extends upward and has a spring biased pin fixed therein. Fitted over the lower portion of the rotating arm is an upper portion of the rotating arm that contains slots in the upper portion to allow the spring biased pin to fit therein. The slots allow the upper portion of the rotating arm to swivel slightly greater than 90 degrees. This swiveling allows a user to easily enter the exercise machine. In addition, the upper portion has at least three lots to adjust the rotating arm up and downward to fit various structure of the user. Attached to the inside of the adjusting members is a pin extending inwardly that provides a stop to the rotating members to prevent the rotating members from going too far. Attached to the bottom of the adjusting members are extension members having a spring biased pin fixed therein. A sleeve, having holes therein is fitted over the extension members. The extension members sit on the surface of the floor or the like as do the semi-circular members. Attached to the sleeve is a first circular pin perpendicular to the sleeve, the first circular pin also having a spring biased pin therein. Attached to the semi-circular member at the mid-point of the semi-circular member is a second circular pin with a spring biased pin fixed therein. Fitted on the first and second circular pins is a resilient member which in the present invention is made from rubber. The spring biased pins on the first and second pins prevent the resilient members from falling off when exercising. The sleeve, when moved to each position, provides an increase or decrease in the tension of the resilient members. A separate notch on the adjustment members is used to place the movable arms in a position to store the arms which are parallel to the seat. It is a further object of the present invention to provide an exercise machine for providing resistance training, including the performance of "ab-crunches" for toning abdominal muscles and for strengthening the muscles of the back.

These and other objects, features and advantages of the present invention will become more readily apparent upon detailed consideration of the following Description of the Preferred Embodiment with reference to the accompanying Drawings.

DESCRIPTION OF THE DRAWINGS

In the drawings which illustrate the best mode presently contemplated for carrying out the present invention are.

The novel features which are believed to be characteristics of the invention, both as its organization and its method of operation, together with further objects and advantages thereof, will be better understood from the following description in connection with the accompanying drawings in which a presently preferred embodiment of the invention is illustrated by way of example. It is to be expressly understood, however, that the drawings are for purposes of illustration and description only, and are not intended as a definition of the limits of the invention.

DESCRIPTION OF THE PREFERRED EMBODIMENT

Figure 1:
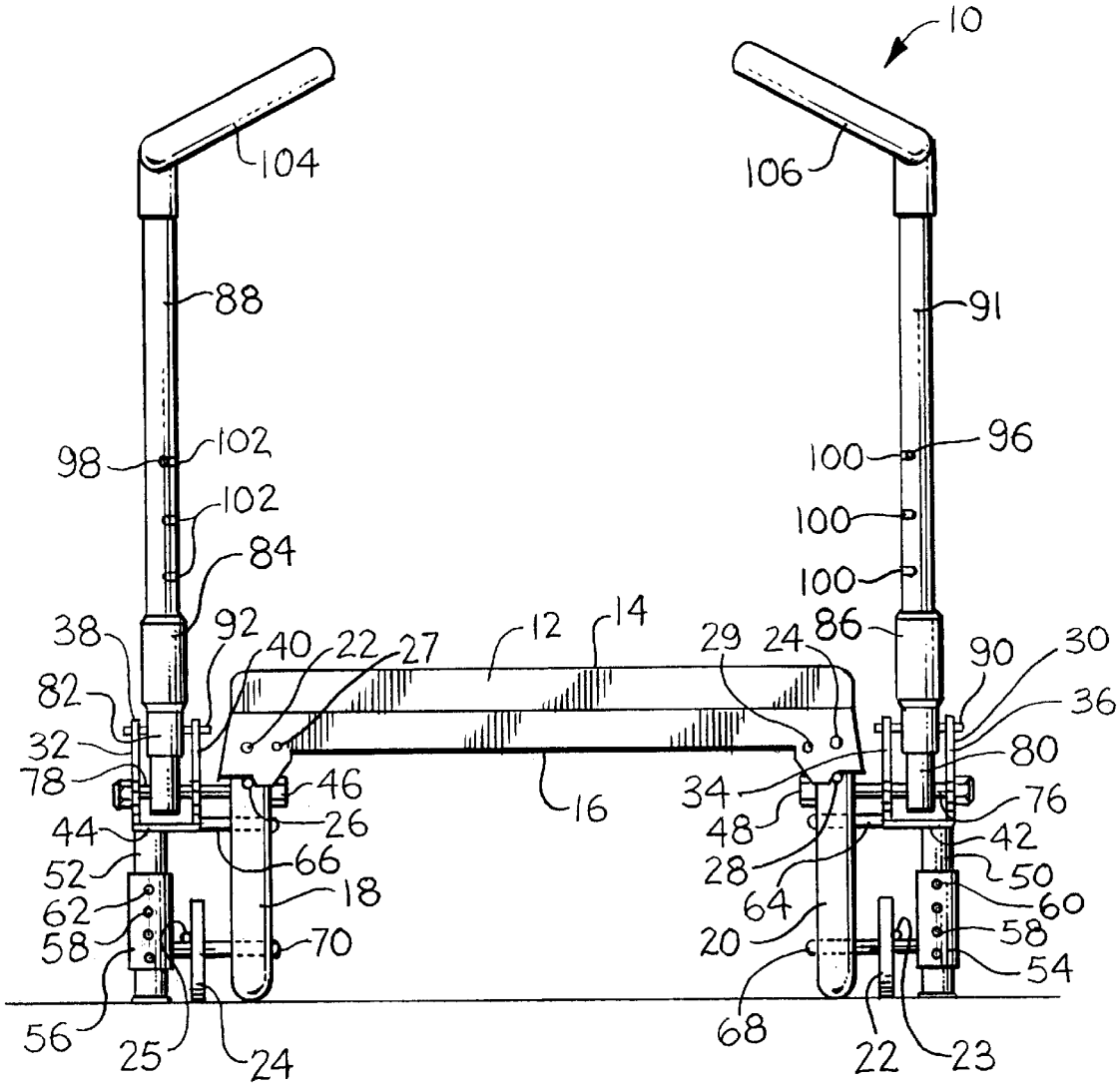
FIG. 1 is a front view of the present invention.
Figure 3:
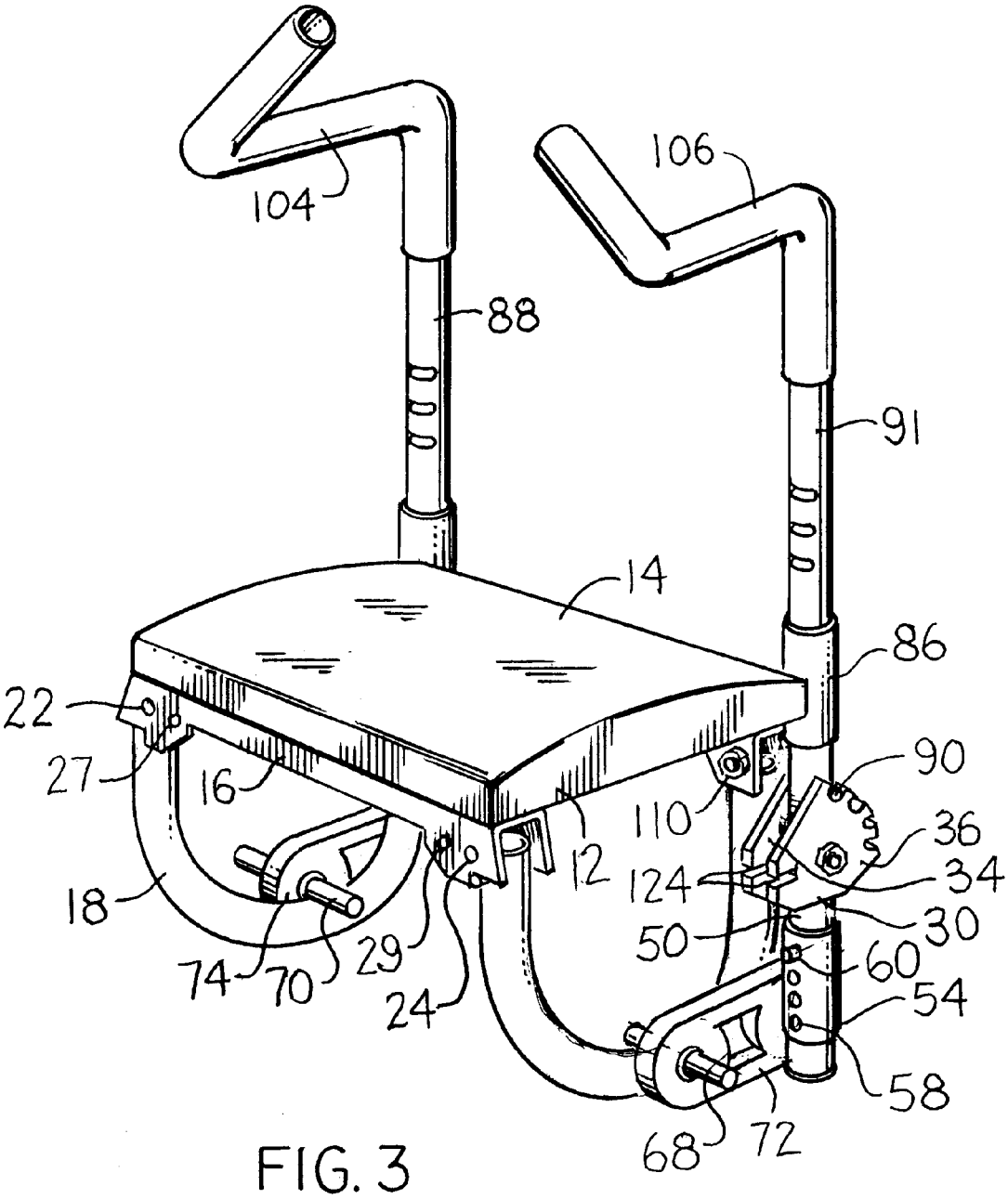
FIG. 3 is a perspective view of the present invention.
Figure 4:
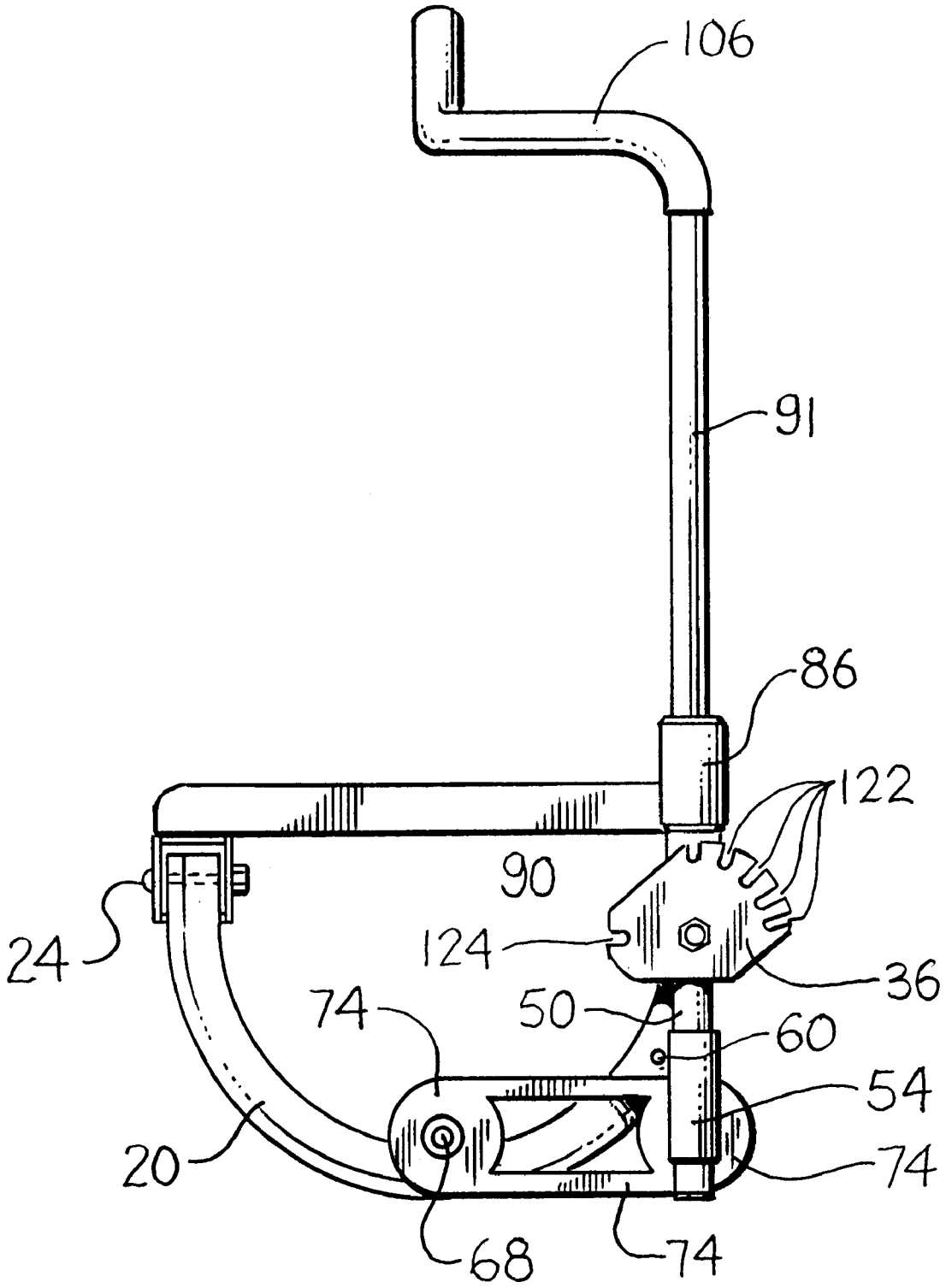
FIG. 4 is a left side view of the present invention.

Turning now to FIG. 1 there is seen a front view of the present invention generally shown as 10. This view shows a seat 12 which consists of a hard material covered by foam rubbers (not shown) and is further covered by waterproof material. Fastened to the seat 12 is a front support member 16 to provide strength to the seat 12. Also in this view are semi-circular tubular members 18 and 20. These semi-circular members 18 and 20 are best seen in FIGS. 3 and 4. Semi-circular members 18 and 20 are hinged by hinge pins 22 and 24 respectively. The semi-circular members 18 and 20 are held in the vertical position by spring biased pins 26 and 28 respectively. Spring biased pins 26 and 28 fit into holes 27 and 29 when semi-circular members 18 and 20 are in a folded position for storage. This view also shows adjusting members 30 and 32 that have two sides 34 and 36 and 38 and 40 respectively. The adjusting members 30 and 32 also have bottoms 42 and 44 that are attached to the sides 34, 36 and 38, 40 respectively. Adjusting members 30 and 32 are attached to semi-circular members 18 and 20 on the rear portion by bolts 46 and 48 whereby the bolt heads are welded to semi-circular members 18 and 20. Attached by welding to the bottom of adjusting members 30 and 32 are extension members 50 and 52 respectively. As seen in FIG. 1 these extension members 50 and 52 bear on a surface as do semi-circular members 18 and 20. Extension members 50 and 52 have sleeves 54 and 56 fitted thereon to slide up and down. Sleeves 54 and 56 have holes 58 drilled therethrough. Spring biased pins 60 and 62 hold sleeves 54 and 56 in one position. Circular pins 64 and 66 are welded to adjusting members 30 and 32 and provide a stop which will be explained later. Circular pins 68 and 70 are welded to the lowest point of semi-circular members 18 and 22. Circular pins 68 and 70 provide a holder for one end of resilient members 72 and 74. Spring biased pins 73 and 75 hold resilient members 72 and 74 on circular pins 68 and 70 which a person is exercising. Bolts 46 and 44 have sleeves 76 and 78 encircling the bolt 44 and 46 inside of adjusting members 30 and 32. These sleeves 76 and 78 are fixed to the lower arms 80 and 82. Spring biased sleeves 84 and 86 slide up and down upper rotating arms 88 and 91. When spring biased sleeves 84 and 86 slide up and down rotating arms 88 and 91, they also move pins 90 and 92 which are affixed to spring biased sleeves 84 and 86. Lower arms 80 and 82 are fitted inside rotating arms 88 and 91. Lower arms 80 and 82 have spring biased pins 96 and 98 that fit in slots 100 and 102. The adjustment of spring biased pins 96 and 98 are in slots 100 and 102 are needed to account for the different structure of a person using the exercise apparatus. Slots 100 and 102 allow the upper arm 88 and 91 to rotate greater than 90 degrees to provide early access to the seat area for a person exercising.

Figure 2:
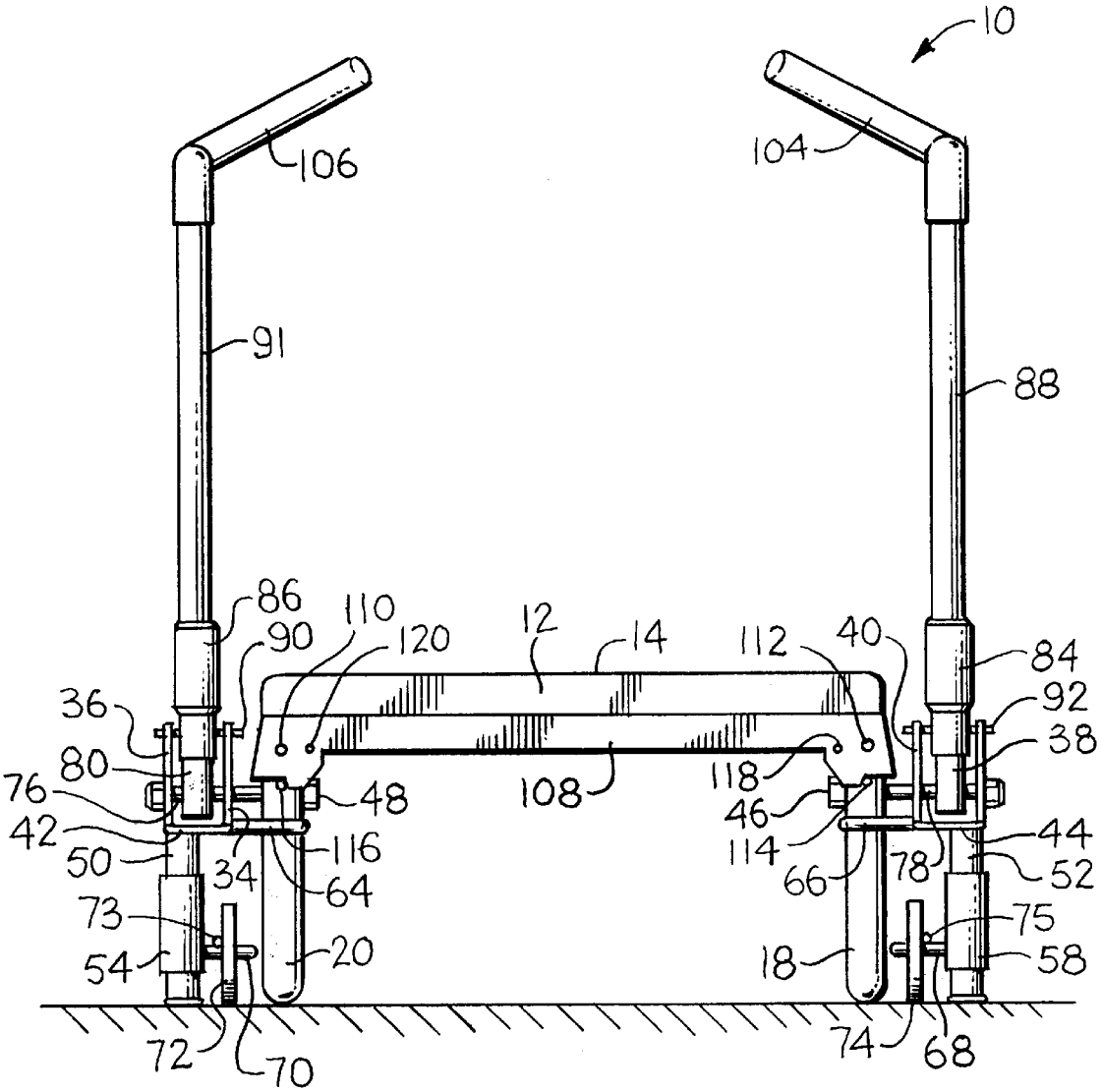
FIG. 2 is a rear view of the present invention.

FIG. 2 gives a rear view of the exercise apparatus 10. In this view there is seen a rear support member 108 attached to seat 12. Many of the same elements in the front view are also identified in the rear view. In this view, it is seen that semi-circular support members 18 and 20 are hinged by pins 110 and 112 respectively. Also, the semi-circular support members 18 and 20 are held in a vertical position by spring biased pins 114 and 116 respectively. Spring biased pins 114 and 116 fit into holes 118 and 120 when the semi-circular members 18 and 20 are in a folded position for storage. In this view, pins 64 and 66 can be seen in their entirety which provides stops to keep the rotating arms 88 and 91 from going all the way forward to the surface where the exercise equipment is placed.

Turning now to FIG. 3, there is seen a perspective view of the present invention showing the adjusting member 30 with the two sides 34 and 36. In this view, notches 122 can be seen that receive pin 90 held in place by the spring biased sleeve 86 where pin 90 is attached. This view also shows hinges 24 and 22 and holes 27 and 29 that receive a spring biased pin in the folded position. Hinge 110 is also seen in this view. This view also shows notches 124 that receive pin 90 when rotating arm 91 is in a folded position for storage.

Turning now to FIG. 4, there is seen a left side view of the present invention. This view clearly shows notches 122 and pin 90 and how the spring biased sleeve 86 forces pin 90 into notches 122. It should be noted that notches 122 are approximately 18 degrees apart as measured from the center of adjusting member 36. The upper rotating arm 91 shows a portion of the rotating arm that is covered with a soft gripping surface 106 to assist the user in gripping the arm. Also seen in this view is the notch 124 that pin 90 fits into when the rotating pin arm 91 is folded down to facilitate storage. It is noted that tension member 74 is made from rubber in the present invention. While the drawings only show one tension member 74, more than one tension member may be used to provide additional resistance. It should be also noted that FIG. 4 shows only the left side. The right side is a mirror image.

The operation of the present invention is simple, the operator moves the rotating arms 88 and 91 out of the way and sits on the seat 12. The operator then moves the spring biased sleeves 84 and 86 to place the pins 90 and 92 in the slot that will give the desired force. The operator holds the rotating arms 88 and 91 in front and bends over "crunching" the abdominal muscles. This exercise is repeated providing an excellent work out of the abdominal muscles and at the same time the back muscles are stretched and are used to place the operator in an upright position to start another set of abdominal "crunching". The operator may also sit on seat 12 in an upright position and instead of bending over, use only the arms to push the rotating arms away from the body. In this manner, the triceps in the arms of the operator receive a work out including muscles in the upper shoulders.

The present disclosure includes that contained in the appended Claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts maybe resorted to without departing from the spirit and scope of the invention.

What is claimed is:

1. An exercise apparatus comprising:

a seat, said seat having a top and a bottom, said seat having a cushion affixed thereto, said bottom of said seat having front and rear support members attached thereto;

two movable arms pivotably mounted to each side of said exercise apparatus;

a semi-circular base member being attached at the right and left side to said front and rear support members by hinge means, said semi-circular base members sit on a solid surface and said semi-circular base members are locked by locking means such that semi-circular base members are perpendicular to said seat bottom, said semi-circular members in the locked position have attached by attaching means an adjusting member having a base and two sides, said two sides having a plurality of notches thereon on both sides, said notches being approximately 18 degrees apart as measured from the center of said adjusting member, each of said adjusting members being fixed and attached by attaching means to each of said semi-circular members, said attaching means being a bolt passing through said semi-circular base member and also passing through said adjusting member, said bolt head being welded to said semi-circular base member, said bolt containing a movable sleeve between the two sides of said adjusting member, said movable sleeve being attached to the bottom portion of a movable arm, said movable arm having a spring biased locking mechanism enclosing the lower portion of said movable arm, said spring biased locking mechanism having pins protruding on each side, said pins engaging said notches in said adjusting members to lock said movable arm in a fixed position relative to said seat, said bottom portion of said movable arm extended upward and having an upper portion of said movable arm being fitted over said lower portion wherein said upper portion can rotate to an angle of greater than 90 degrees, said upper portion of said movable arm being restricted in rotation by a spring biased pin in a slot in said movable arm, said upper portion of said movable arm having at least three slots wherein said upper portion of said movable arm can be adjusted to fit the structure of the user, said base of said adjusting member having an extension welded thereon wherein said extension has a sleeve with holes therein which provides adjusting means by energizing a spring biased pin fixed in said extension.

2. An exercise apparatus as described in claim 1 further comprising:

said semi-circular members having a circular pin attached at a point half the distance of the semi-circle, said circular pin containing a spring biased pin to contain one end of a resilient means, said sleeve having a circular pin extending perpendicular to said sleeve, said sleeve having a spring biased pin to contain one end of resilient means, moving said sleeve and providing adjusting means by said spring biased pin fitted into said holes in said sleeve changes the tension in said resilient means, said adjusting member having attached thereto a circular pin that acts as a stop to prevent said movable arms from moving to an extended forward position, said semi-circular base members being rotated to the bottom of said seat by hinge means, said hinge means having a spring biased pin that releases said semi-circular base members and allows said semi-circular base members to be parallel to said bottom of said seat for storage, said adjusting members having a single notch separate from said plurality of notches, said single notch being positioned so that when spring biased locking mechanism protruding pin engages said single slot, said movable arm will fold parallel to said seat for storage.

* * * * *